United States Patent [19]

Moon

[11] Patent Number: 4,493,312

[45] Date of Patent: Jan. 15, 1985

[54] INDUCTION FLUID SUPPLY UNIT FOR EXHAUST HOOD APPARATUS

[75] Inventor: Michael L. Moon, West Bend, Wis.

[73] Assignee: Maysteel Corporation, Mayville, Wis.

[21] Appl. No.: 342,247

[22] Filed: Jan. 25, 1982

[51] Int. Cl.[3] ..... F23J 11/00

[52] U.S. Cl. ..... 126/299 D; 55/415; 55/418; 55/DIG. 36; 98/36; 98/115.1; 239/455; 239/461

[58] Field of Search ..... 98/36, 40 N, 115 R; 55/415, 418, DIG. 36; 239/455, 456, 461, 587; 126/299 R, 299 D

[56] References Cited

U.S. PATENT DOCUMENTS

| | | | |
|---|---|---|---|
| 3,664,255 | 5/1972 | Kuechler | 126/299 D |
| 3,978,777 | 9/1976 | Hett | 126/299 D |
| 4,011,802 | 3/1977 | Molitor et al. | 126/299 D |
| 4,117,833 | 10/1978 | Mueller | 98/40 H X |

FOREIGN PATENT DOCUMENTS

| | | | |
|---|---|---|---|
| 24931 | 11/1922 | France | 239/587 |

*Primary Examiner*—Harold Joyce

*Attorney, Agent, or Firm*—Andrus, Sceales, Starke & Sawall

[57] ABSTRACT

A self-contained induction air supply unit is provided for an exhaust hood having an exhaust fan drawing of freeze laden air through an angled filter. The supply unit includes a supply chamber with a bottom stream forming slot having a curved bottom wall for turning air through the slot and into the exhaust hood. An air deflector includes an adjustable support coupled to the curved bottom wall to vary the angular orientation of the stream to permit changing the angle of the induction air stream for proper engagement with the filter and simultaneously change the curved bottom wall. The deflector in one form includes a single plate having a curved portion abutting the underside of the curved bottom wall and an outer planar portion. In another structure the curved bottom slot wall is flexibly mounted. A deflector plate is pivotally mounted beneath the outer end of flexibly mounted wall and projects outwardly thereof. The pivoting plate deflects the curved bottom wall to change its radius with the changing of the angular position of the deflector plate.

4 Claims, 5 Drawing Figures

INDUCTION FLUID SUPPLY UNIT FOR EXHAUST HOOD APPARATUS

BACKGROUND OF THE INVENTION

The present invention relates to an induction fluid supply unit for an induction exhaust apparatus and particularly such apparatus for ventilating of an enclosed area.

Exhaust hoods are widely used to exhaust contaminated air from an enclosed area such as a restaurant kitchen area, an industrial work area and the like. The exhaust air is preferably filtered to remove certain foreign products such as grease prior to discharge of the air or other fluid from the exhaust apparatus. Highly efficient exhaust apparatus has been developed wherein an induction air jet or stream is directed through an exhaust hood and into engagement with a filter. The induction air stream serves to induce the movement of the contaminated air from the enclosed area into the hood. The slot structure is important to maintain a smooth, turning characteristic which contributes to efficient and effective operation and functioning of the induction air stream. U.S. Pat. Nos. 3,978,777 and 4,047,519 which issued to Louis Nett disclose particularly effective and efficient exhaust hood apparatus of the inducted air stream principles and which have been widely used in restaurant kitchens and the like. The patents disclose a unique air slot having a curved bottom wall to form the induction air stream. The induction air stream in the above apparatus is untempered exterior air. Untempered air of course significantly minimizes the load on the heating and cooling systems for the enclosed area within which the hood is located.

As more fully disclosed in the above patents, the exhaust apparatus includes a filter within the hood which is set at a selected angle to the vertical. The air stream preferably engages the filter at substantially a right angle and has a velocity and mass which permits complete discharge through the filter so as to avoid spill or roll-off of the stream along the filter and vortexing within the hood which can disrupt the air pattern within the exhaust hood. Spill-over and/or vortexing can significantly reduce the effective operation of the exhaust hood and particularly interfere with the efficient removal of the contaminated air from the enclosed area. An original design and construction of an exhaust hood can of course properly locate the air stream source and the filter. However, many existing non-induction exhaust hood units are in place which could advantageously be modified to an induction exhaust principle. Further, various induction units could be improved by incorporating an induction air stream slot such as shown in the Nett patents. However, to provide a custom modification for each such hood is difficult and practically costly. Thus, the various existing exhaust hoods have the filters at widely different angular orientations. Consequently, it is impossible to provide a single supply unit with a properly located nozzle to provide an induction air stream of proper orientation for all such existing units. The conversion or retrofitting of existing units is particularly difficult where the highly advantageous slot structure having the curved bottom wall means is to be incorporated into the existing units.

SUMMARY OF THE INVENTION

The present invention provides an air supply unit for an induction exhaust hood including an essentially curved wall means for an effective continuous turning of the air into the exhaust hood in combination with an adjustable air directing means coupled to such curved bottom wall for controlling the direction of the induction airstream through the hood. The adjustable air directing means permits setting of the structure with a desired movement of the airstream through the exhaust hood for proper engagement with the filter, or for any other reason. Generally in accordance with the present invention, the fluid supply unit includes a supply chamber having an input fluid supply connection and a stream forming slot including an essentially continuously curved bottom wall means for effective turning of the air from the supply chamber through the slot and into the exhaust hood. An air directing unit or means is coupled to said essentially continuously curved wall means and includes a stream directing wall mounted to form a continuation of the curved wall means. In accordance with the present invention, the air directing means includes an adjustable mounting or positioning means coupled to the curved wall means which provides for selective positioning of the directing wall means to vary the angular orientation of the stream and simultaneously changes the curved wall means of the slot to produce continued proper movement of the airstream through the air slot and the exhaust apparatus.

In accordance with another aspect of this invention, a locking means is provided fixedly securing the air directing means in place. Thus, after the air directing means has been located in the proper desired position for providing an effective movement of the airstream into engagement with the filter or the like, the locking means is set to fixedly secure it in position and prevent further adjustment thereof. This prevents the user from disturbing the optimum positioning of the air directing means.

In one preferred and unique embodiment of the invention, the air supply unit is formed with the curved bottom wall terminating within the discharge slot. The air directing means includes an adjustable air deflector wall unit having a curved coupling portion complementing the fixed curved bottom slot wall and a substantially planar portion extending outwardly from said curved coupling portion. The coupling portion abuts the fixed curved bottom wall and is mounted for adjustable positioning about the curved bottom wall, thereby providing for adjustment of the extension and angular orientation of the flat planar portion as well as the extension of the curved bottom slot wall. The supply plenum is mounted within or to an existing hood structure, and the air directing wall unit positioned to properly locate the planar portion such that the air stream properly engages the existing filter. The velocity of the airstream is adjusted to a fixed balanced condition, and the wall is affixedly attached in place. A simple and reliable locking means includes pop-riveting of the plate to the curved bottom slot wall.

The air directing wall is preferably a single thickness plate member which is conveniently supported abutting the underside of the curved bottom slot wall by a spaced correspondingly shaped curved support wall.

In a second embodiment of the invention, the supply unit includes the curved bottom slot wall which is mounted to permit flexing of the slot wall. An air directing unit includes a plate-like member mounted immediately beneath the outer end portion of the bottom slot wall. The plate is adjustably mounted to permit positioning thereof against the bottom slot wall, with the angular orientation and direction adjustable for establishing proper direction of the induction stream. The positioning of the plate results in a simultaneous deflection of the curved bottom, thereby changing the radius and maintaining smooth continuous turning of the air. In a particular practical embodiment, the deflection plate may be constructed in the form of hair pin cross section, with the ends of the arms pivotally mounted beneath the bottom slot wall. One arm is fixedly hinged to the plenum. The opposite arm is hinged to a laterally adjustable bracket. A screw-type mechanism or the like is coupled to the plate for lateral positioning thereof. The lateral movement of the hinge bracket results in the pivoting of the plate about the fixed hinge and angular positioning thereof. Once properly positioned, the adjustment means is fixedly locked in place as by suitable covering of the screw with a non-releasable cap, a sealable sealant or the like.

The present invention thus provides a supply unit particularly adapted for retrofit applications to the existing exhaust hoods without the necessity for extensive custom reconstruction of the exhaust hood while producing an optimum air stream forming slot structure to produce a highly efficient induction fluid stream which is properly positioned within the hood.

DESCRIPTION OF THE DRAWINGS

The drawings furnished herewith illustrate a preferred construction of the present invention in which the above advantages and features are clearly disclosed as well as others which will be readily understood from the following description.

In the drawings.

DESCRIPTION OF THE ILLUSTRATED EMBODIMENT

Figure 1:
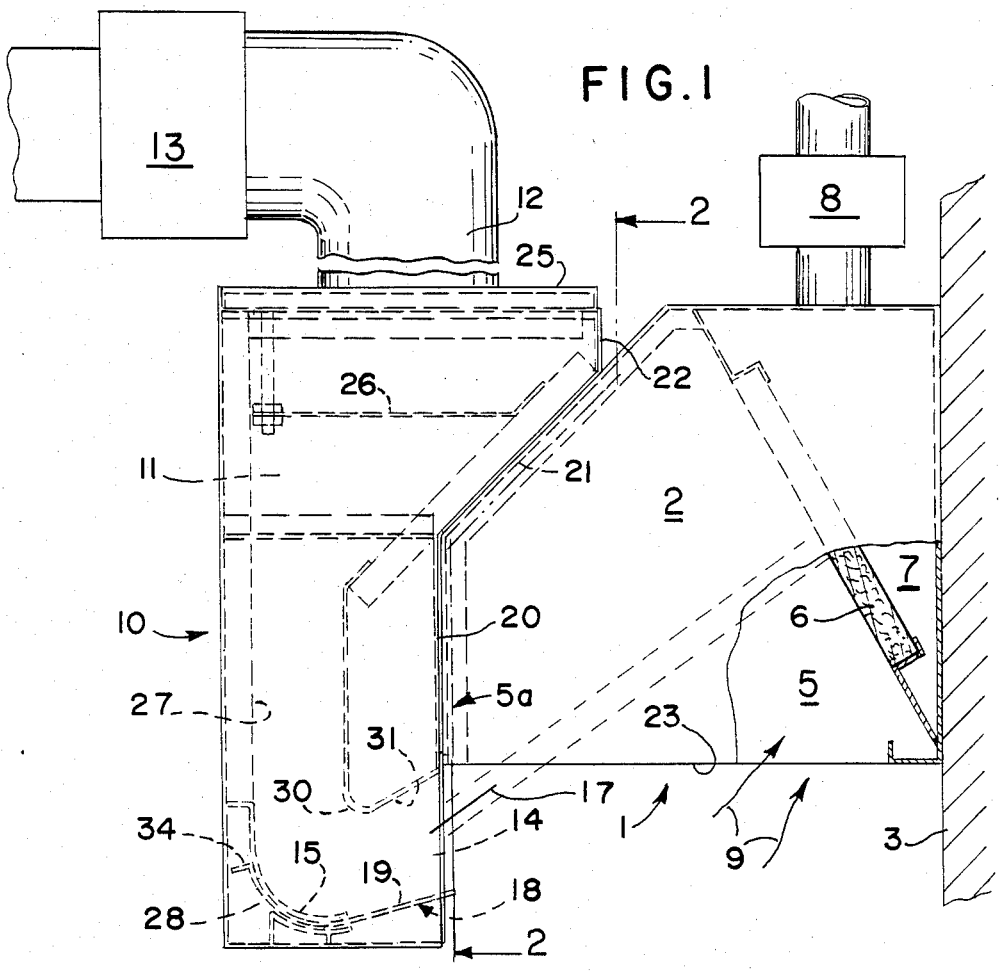
FIG. 1 is a side elevational view of a air supply unit attached to a typical existing exhaust hood.

Referring to the drawings and particularly to FIG. 1, an exhaust hood 1 is illustrated such as typically employed for exhausting of the air from a restaurant kitchen area for removing of odors and fumes from the area. The illustrated exhaust hood is of canopy type and includes a substantially rectangular hood enclosure 2 which is adapted to be installed abutting a structure wall 3 and overlying a stove, grill, not shown, or other cooking means within a kitchen area. The hood 1 is a four sided enclosure having a top wall to define an open bottom collection chamber 5, which in general practice is somewhat larger in the area than the cooking area or equipment.

The existing exhaust hood is generally formed with the front wall 5*a* of the canopy having a lower vertical wall portion and an inwardly inclined upper wall portion which slants upwardly to the top wall of the canopy. The bottom edge of the existing hood is generally spaced significantly above the cooking area. The hood includes a grease filter 6 which is mounted in angular relation within an exhaust opening 7. An exhaust fan 8 is coupled to the opening 7 to draw the fume-laden air 9 upwardly from the room through the bottom opening into the hood and through the filter 6. The fume-laden air is exhausted to the exterior of the kitchen or other enclosed area. The grease filter 6 of course covers the length and width of the exhaust opening to allow maximum collection and discharge of the filtered air. The exhaust hood 1 as thus described is a simplified version of a conventional exhaust hood relying solely on the exhaust fan 8 to remove the fume-laden air.

In accordance with the illustrated embodiment of this invention, an air supply unit 10 is attached to the exhaust hood 1 and converts it into an induction air exhaust apparatus.

The present invention is particularly directed to the construction of the air supply unit. The balance of the hood structure may be of any well known or desired construction and no further description thereof is given other than necessary to fully explain the illustrated embodiment of the present invention.

In the embodiment shown, the air supply unit 10 is constructed as a self-contained plenum adapted to be mounted directly to the front wall of the exhaust hood 1 and spanning the width of the hood. The air supply unit 10 is generally a rectangular box-like structure defining an air supply chamber 11 having an air supply duct 12 on the top, adapted to be connected to a source of the air such as untempered, outside air. A supply fan means 13 is shown mounted to the roof of the building and suitably connected to introduce outside air under pressure into the upper end of the supply chamber 11. The air supply unit 10 extends downwardly beneath the bottom edge of the hood 1 and includes a discharge slot 14 located in the lower portion of the supply unit 10. The slot 14 discharges the pressurized air as a high velocity jet or air stream into the exhaust hood 1. An essentially continuously curved bottom wall means defines the bottom of the discharge slot 14 for effective continuous turning of the pressurized air in said supply chamber through said slot 14 and into the exhaust hood 1. The curved bottom wall 15 functions, as more fully described in the previously identified U.S. patents, to produce smooth turning of the air so as to develop and maintain laminar flow in the slot 14 and a narrow laminar induction air stream 17 immediately outwardly of the slot 14. This contributes to the production of a relatively thin and effective induction air stream moving through the hood 1 and into engagement with the filter 6.

Figure 2:
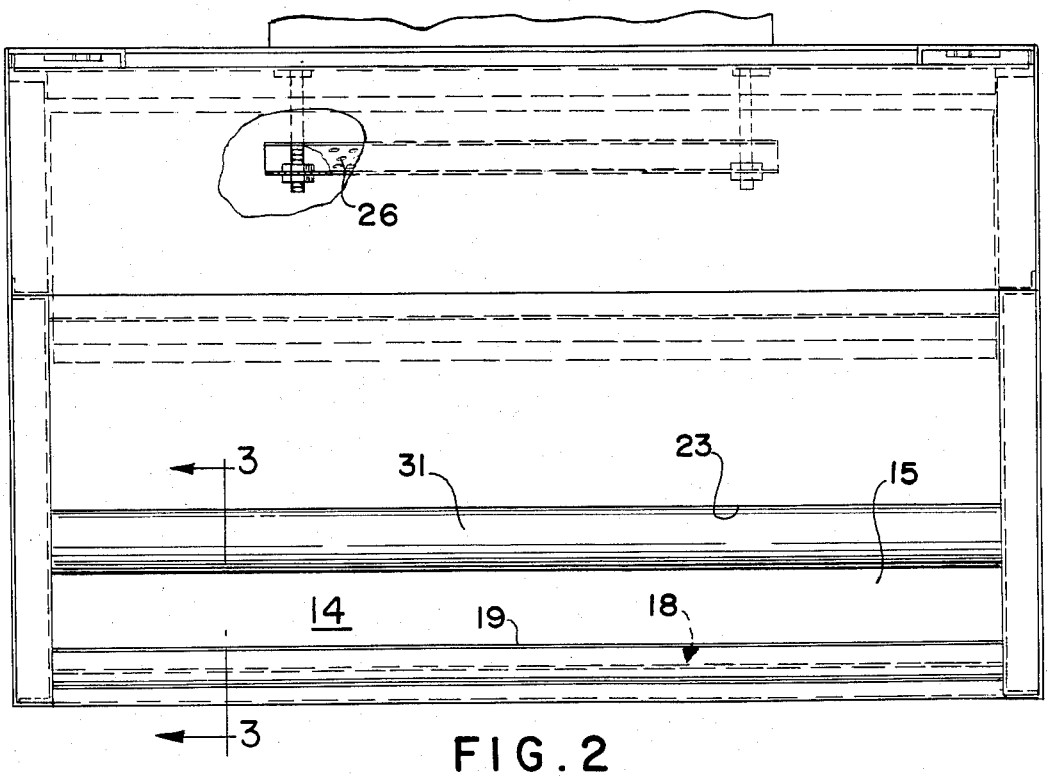
FIG. 2 is a front elevational view of the air supply unit and hood shown in FIG. 1.
Figure 3:
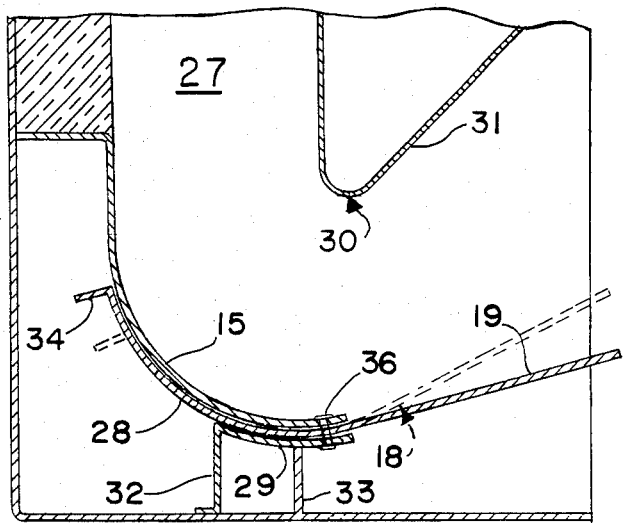
FIG. 3 is an enlarged vertical section taken generally on line 3—3 of FIG. 2 and more clearly illustrating the adjustable mounting of the stream directing wall means shown in FIGS. 1 and 2.

The filter 6 in an existing exhaust hood 1 may be set at any one of many different angles because a standard angular relationship has never existed. The induction air stream discharge slot 14 is constructed with an air directing means 18 for reorienting and adjusting the angular orientation of the induction air jet or stream, so as to permit optimum interengagement with the grease filter 6. Generally, the jet stream 17 engages the filter 6 at essentially 90° so as to permit maximum flow of the stream through the filter, with essentially no roll-off of the stream above and below the path of the induction stream 17. Thus, with the jet stream 17 located to properly engage the filter 6, the air velocity of the jet stream 17 can be adjusted to establish a balanced condition between the air engaging and passing through the filter. In the embodiment of FIGS. 1–3, the air directing wall means 18 is coupled to the curved bottom slot wall 15 with an inwardly extending portion 19 forming an extension of the bottom slot wall 15. The air directing means 18, as more fully developed hereinafter, is adjustably mounted to permit adjustment of the angular orientation of the extending portion 19 while simultaneously changing the effective length of the curved bottom slot wall 15. The anular position of the portion 19 thus determines the angular path of the induction air stream 17 through the hood 1 and particularly its angle of engagement with the filter 6.

Thus referring particularly to FIGS. 2 and 3, the air supply unit includes a separate housing consisting of an outer or front wall, sidewalls and a bottom wall interconnected to each other to form an enclosure. The inner wall of the supply unit 10 includes a substantial vertical portion 20 extending upwardly from the bottom wall. The upper end of the side walls and the inner wall are extended upwardly at an angle as at 21 to an uppermost short vertical wall 22. This angular relationship permits attachment of the supply unit to the exterior of an existing canopy which is often formed with such a sloping portion 5*a*. The lower end of the air supply unit and particularly the front wall thus depends downwardly below the bottommost edge 23 of the existing canopy or hood 1. The air discharge slot 14 is located in the lower end of the front wall. The top wall 25 is specially constructed with the duct member 12 for introducing of air into the intake chamber 11. The untempered air is distributed throughout the width and length of the intake chamber 11 by a diffuser plate 26 suitably mounted in the upper portion of the intake chamber to thus provide a more uniform supply of air through the intake chamber and thus to the slot 14.

The air supply unit 10 is suitably mounted abutting the depending front wall of the existing canopy to locate the lower end of the supply unit 10 depending downwardly below the existing canopy, as most clearly shown in FIG. 3. In particular, the air supply unit 10 is located with the discharge air slot 14 located beneath the canopy such that the induction air stream 17 moves from the slot upwardly into the existing hood 1 and into engagement with the angularly oriented filter 6.

The angled inner wall 21 of the supply unit 10 provide a progressively decreasing cross-section in the top portion or area of the intake chamber 11. The reducing cross-section terminates in the upper end of a vertical transfer passageway 27, which directs the air downwardly into the upper end of the discharge slot 14. This results in an increasing air velocity as it moves from the upper end of the air intake chamber to provide a relatively high velocity air movement through the slot 14 to form stream 17.

The slot 14 is constructed to properly turn the high velocity air and redirect it into the fume collection chamber of hood 1 in a smooth continuous manner so as to produce a laminar flow of the induction air stream introduced into the collection chamber. The bottom wall 15 of the slot 14 is formed as a generally shallow U-shaped member extending from the vertical passage 27 and having a sufficient curvature to smoothly and continuously turn the air without creation of any significant turbulence. The curved bottom slot wall 15 is shown as a curved plate member which is suitably secured within and to the front and side walls of the air supply unit 10. The slot wall 15, of course, extends throughout the width of the supply unit to provide an induction stream 17 which covers the bottom open end of hood 1.

The bottom slot wall 15 is shown in a preferred embodiment with a continuously smooth curved surface. The wall 15 can of course be otherwise formed, such as by a series of small breaks to thereby effectively approach a curved surface which may provide a relatively smooth and continuous turning of the air. The air directing means 18 is coupled to the curved bottom slot wall 15.

In the embodiment of FIGS. 1–3, the air directing wall means 18 consists of a curved portion 28 having curvature complementing the curvature and abutting of the bottom slot wall 15. The inwardly extending portion 19 is a planar air deflecting portion which is integrally formed with the curved portion 28 and projects outwardly therefrom to provide a continuation of the bottom wall 15 for proper finally directing of the induction air stream 17 into the hood 1. The curved bottom slot wall 15 thus terminates substantially inwardly of the laterally outermost discharge end of the slot 14. The air deflecting wall means 18 is mounted immediately beneath the bottom slot wall 15 with the curved portion held in abutting engagement with the underside thereof by a correspondingly curved byport wall 29. The air directing wall 10 can of course be moved about the bottom slot wall 15 with the wall means 18 moved inwardly to the innermost position, the flat or planar wall portion 19 immediately engages the end of the curved bottom slot wall 15 and protrudes therefrom with a minimum angle to the horizontal. As the deflector wall 18 is moved outwardly about the slot wall 15, the curved portion 28 extends into the slot 14 and defines an increasing curved bottom slot wall, thereby increasing the length of the curved portion of the slot. Simultaneously, the planar air directing portion 19 pivots and moves upwardly into the air slot 14 increasing the angular positioning thereof with respect to the horizontal, and correspondingly redirecting of the air upwardly at a sharper angle into the hood. As illustrated in the drawings, the adjustable wall means provides for adjustment of the air directing plate portion or between 15° and 45° to the horizontal, which has been found to provide a commercially acceptable range for a self contained retrofit supply unit.

The slot 14 is completed by generally inverted U-shaped upper wall structure 30, which extends smoothly from the end of the vertical intake passageway 27 and turns rapidly upwardly to form an inclined inner top wall 31. The angle of the inclined top wall 31 is selected to correspond to the maximum angle of the air deflector plate portions. This permits the effective turning of the air wit-out any interference with the air stream as it is admitted or injected into the hood 1.

The curved support wall 29 for the air wall 18 is secured to the bottom wall of the air intake supply unit 10 by suitable leg members 32 and 33. The curved support wall 29 is spaced from the bottom slot wall 15 by essentially the thickness of the adjustable air deflector wall 18. The adjustable air deflector wall 18 is slidably disposed therein for selective positioning about the curved bottom slot wall 15. A stop 34 is secured to the innermost edge of the curved portion for limiting the positioning thereof with respect to the bottom slot wall.

The air supply unit 10 is formed as a factory built basic unit and delivered to the installation site with the air deflector wall means freely adjustably mounted within the air intake unit. The factory assembled unit is appropriately mounted in position to form an extension and integrated part of the existing canopy or exhaust hood, with the addition of the necessary untempered air supply duct and fan. After installation, the adjustable air deflector is selectively positioned about the bottom wall to locate the air directing planar plate portion 19 at the desired angle with respect to the existing filter 6, and preferably providing optimum interengagement of the induction air stream with the filter. The length of the exposed curved portion 28 of the wall slot 15 varies with the angular positioning of the air deflector wall means, and particular increase as the angle of deflection is increased. Thus, as the angle of deflection increases, there is a longer turning area. The unit 10 is properly balanced with the air velocity adjusted to develop a proper supply of air to the filter 6. The air deflector is then secured in place by a suitable blind rivet 36 or the like.

Figure 4:
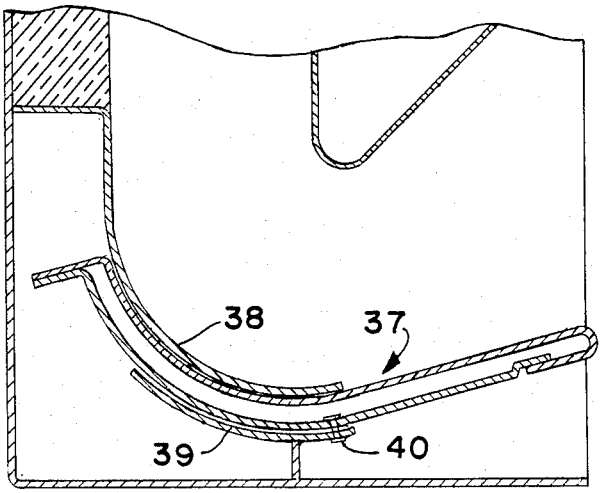
FIG. 4 is a view similar to FIG. 3 illustrating an alternate embodiment of the invention.

The inventor has found that the air deflector means maintains highly efficient turning action of the air while permitting accurate and reliable setting of the induction air stream in an exhaust hood without the necessity of a custom built air supply unit. Modifications of the structure of the air deflector means may of course be made within the teaching of this invention. For example, in FIG. 4, a similar double walled air deflector unit is shown. The double wall deflector unit 37 is similarly supported within the bottom wall structure 38 by suitable location of a curved support wall 39. A rivet or sheet metal screw 40 passes through the support wall and the bottom wall of the air deflector unit to rigidly and fixedly secure the air deflector unit 37 in place. The embodiment of FIG. 4 functions in the same manner as the first embodiment.

Figure 5:
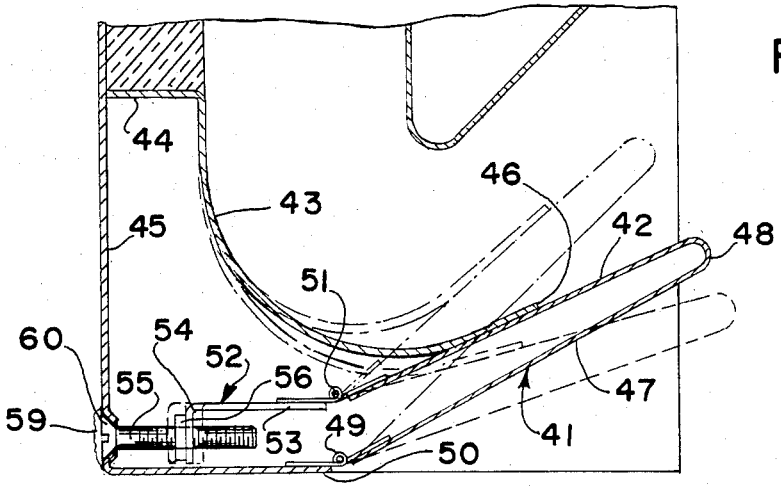
FIG. 5 is a view of a further embodiment of the present invention.

Although the combined curved and flat wall deflector as shown in the above embodiments provide a highly satisfactory and preferred construction, other means may of course be provided to maintain the desired air turning characteristic in combination with an air directing plate for directing and introducing of the induction airstream into the hood. For example, a further embodiment of the invention is illustrated in FIG. 5 which is a fragmentary view of the lower end section of an air supply unit such as shown in FIGS. 1 and 2. Common elements are correspondingly numbered for simplification of explanation. An air deflector means 41 is shown with a pivotally mounted plate-like member 42. A curved bottom slot wall 43 particularly projects vertically downwardly from an upper horizontal support ledge 44 and then curves downwardly and forwardly in a smooth, continuous curve. The slot wall 43 is secured by the top wall 44 to the front wall 45 of the supply unit 10, but the side edges are not secured in place. The bottom slot wall 43 is in this embodiment formed of a suitable flexible metal such as an 24 gauge stainless steel. The outermost end 46 of wall 44 thereof engages the central portion of the air deflector unit and particularly plate 42 which forms the support therefor. The air deflector unit 41 is generally a plate-like member which is adapted to be pivoted between the several angular orientations, generally between 15° and 45°. In this embodiment of the invention, the bottom wall 43 is deflected as it follows the positioning of the air deflector unit 41 and thereby directly and slightly changes the curvature of the bottom wall 43. The curvature is selected to provide the desired continuous and relatively smooth turning of the air stream in all positions of the air deflector unit 41. The air deflector unit 41 and particularly plate 42 creates a planar or flat extension from the outermost end of the curved bottom wall 43.

In the illustrated embodiment of FIG. 5, the air deflector unit 41 is shown formed with a generally hairpin cross-section having a bottom plate 47 generally parallel to plate 42 and having the innermost discharge end closed by a curved end wall 48. The top wall or plate 42 of the deflector unit 1 is located immediately beneath and in abutting engagement with the underside of the free end of the curved bottom slot wall 43. The outer ends of the top and bottom plates 41 and 47 are separately hinged to a support structure. The bottom plate 47 is hinged by a suitable continuous hinge 49 to the bottom wall 50 of the air intake unit 10. Hinge 49 provides a fixed pivot support for the bottom wall of the deflector unit 10. A similar continuous hinge 51 connects the inner end of the top deflector plate 42 to a movable bracket 52 and similarly pivotally supports the deflector unit 10. Bracket 42 is illustrated as a generally L-shaped or right angle member having a horizontal leg 53 fixed to the one side of the continuous hinge 5. The opposite leg or side 54 of the bracket 52 depends downwardly and is coupled to an adjustment screw 55 for positioning the deflector plate 42. Thus, the side 54 includes a threaded opening shown as an attached nut 56, located to receive the screw 55. The screw 55 is rotatably mounted in the front wall 45 of the unit 10, but is held axially fixed in place as by the resilient plate 45. Thus, turning of screw 55 repositions the bracket 52 lateral of the slot 14. The resulting movement of the hinge 51 forces the plate 42 to pivot and move simultaneously about the hing 51, and also the fixed hinge 49. Thus, the air deflector unit 10 can be readily adjusted to a precise angle for proper location of the air stream with respect to a filter such as shown in FIGS. 1–3. After proper positioning of the air deflector unit 41, the adjustment means is preferably locked in place. For example, a fixed cap may be secured over the screw or a suitable sealant 59 applied over the recessed screw head 60, as shown in FIG. 5.

In the embodiment of FIG. 5, the positioning of the deflector unit 41 generally functions as in the other embodiments to simultaneously adjust the angle of the stream and the configuration of the curved bottom slot wall in such a manner as to produce a highly effective induction air stream within the hood apparatus.

Various modifications may be provided, and if a high quality and optimum result is not desired or required various simplifications and modifications might be used. For example, a simple hinged air deflector might be provided on the end of the slot wall. The present invention thus provides simple and practical retrofit fluid supply units for creation of an effective induction air stream in an exhaust hood or the like.

Various modes of carrying out the invention are contemplated as being within the scope of the following claims particularly pointing out and distinctly claiming the subject matter which is regarded as the invention.

I claim:

1. An exhaust hood supply apparatus for injection air into an exhaust hood, an air supply plenum, a slot in said plenum having a substantially continuously curved bottom wall, a separate deflecting plate having a curved coupling wall mounted in abutting movable engagement with said bottom wall, said deflector plate having an extension portion projecting outwardly of said coupling wall to direct said air across the plenum, said curve coupling wall adapted to be pivotally moved over said bottom wall to establish a desired optimum positioning of said extension portion and correspondingly changing the total curved length of said curved bottom wall and said coupling wall, and wherein said curved coupling wall complements said curved bottom wall and said extension portion is a planar portion.

2. The exhaust hood supply apparatus of claim 1 including means to fixedly secure said deflecting plate in said preselected desired position.

3. The exhaust hood supply apparatus of claim 1 wherein said deflecting plate is a single thickness self-supporting plate, and having a support wall secured to the underside of said curved bottom wall in spaced relationship to said curved bottom wall to define a supporting slot for the curved coupling wall.

4. The exhaust hood supply apparatus of claim 1 wherein said coupling wall is a double wall member.

* * * * *

UNITED STATES PATENT AND TRADEMARK OFFICE

CERTIFICATE OF CORRECTION

PATENT NO. : 4,493,312

DATED : January 15, 1985

INVENTOR(S) : MICHAEL L. MOON

It is certified that error appears in the above-identified patent and that said Letters Patent is hereby corrected as shown below:

Column 5, Line 7, Delete "anular" and substitute therefore ---angular---; Column 6, Line 51, Delete "wit-out" and substitute therefore ---without---; Column 8, Line 6, Delete "1" and substitute therefore ---41---; Column 8, Line 9, Delete "41" and substitute therefore ---42---; Column 8, Line 14, Delete "10" and substitute therefore ---41---; Column 8, Line 17, Delete "10" and substitute therefore ---41---; Column 8, Line 30, Delete "hing" and substitute therefore ---hinge---; Column 8, Line31, Delete "10" and substitute therefore ---41---; Column 8, Line 58, Delete "injection" and substitute therefore ---injecting---;

Signed and Sealed this

*Eleventh* Day of *June 1985*

[SEAL]

*Attest:*

DONALD J. QUIGG

*Attesting Officer* *Acting Commissioner of Patents and Trademarks*